US006129789A

United States Patent [19]

Kawase et al.

[11] Patent Number: 6,129,789

[45] **Date of Patent: *Oct. 10, 2000**

[54] SURFACE TREATMENT METHOD OF HYDROGEN ABSORBING ALLOY

[75] Inventors: Hiroshi Kawase, Kariya; Shin-ichi Towata, Nagoya; Kazuhiko Itoh, Seto; Shunsuke Yamakawa; Katsushi Abe, both of Aichi-ken; Yutaka Ohya; Shinya Morishita, both of Nagoya, all of Japan

[73] Assignee: Kabushiki Kaisha Toyoda Jidoshokki Seisakusho, Kariya, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/768,309

[22] Filed: Dec. 17, 1996

[30] Foreign Application Priority Data

Dec. 21, 1995 [JP] Japan ..... 7-350406

[51] Int. Cl.[7] ..... C23C 8/16

[52] U.S. Cl. ..... 148/281; 148/286; 148/712; 428/472.1; 429/59; 429/101; 420/900

[58] Field of Search ..... 148/712, 707, 148/675, 400, 442, 426, 429, 428, 427, 281, 285, 286, 287; 429/59, 101, 17, 19; 204/293; 420/900; 428/472.1

[56] References Cited

U.S. PATENT DOCUMENTS

| | | | |
|---|---|---|---|
| 2,827,405 | 3/1958 | Evans et al. | 148/284 |
| 3,556,870 | 1/1971 | Debray et al. | 148/281 |
| 5,211,921 | 5/1993 | Sommers et al. | 423/644 |
| 5,328,524 | 7/1994 | Hertz | 148/281 |
| 5,499,279 | 3/1996 | Chakvaborty | 420/900 |

FOREIGN PATENT DOCUMENTS

| | | | |
|---|---|---|---|
| 42-18057 | 9/1967 | Japan | 148/284 |
| 59-208036 | 11/1984 | Japan . | |
| 03289047 | 12/1991 | Japan . | |
| 04009692 | 1/1992 | Japan . | |
| 04106872 | 4/1992 | Japan . | |
| 06187980 | 7/1994 | Japan . | |
| 07166173 | 6/1995 | Japan . | |
| 94-23188 | 10/1994 | WIPO . | |

OTHER PUBLICATIONS

Abstract of Japanese Patent No. 3–289047, patent issued Dec. 19, 1991.

Abstract of Japanese Patent No. 4–137361, patent issued May 12, 1992.

Abstract of Japanese Patent No. 5–13077, patent issued Jan. 22, 1993.

*Primary Examiner*—Margery Phipps

*Attorney, Agent, or Firm*—Morgan & Finnegan, L.L.P.

[57] ABSTRACT

Steam is contacted with a hydrogen absorbing alloy in a temperature range from 200° C. to 400° C. With a contact catalytic reaction of water, a metal contained in the hydrogen absorbing alloy is changed to an oxide or a hydroxide. Hydrogen produced causes the Ni compound to be reduced and thereby the Ni metal that is catalytically active is produced. Thus, the surface of the hydrogen absorbing alloy is activated. The steam is contained in an inert gas or a reductive gas. This treatment method is suitable as an activation treatment for a hydrogen absorbing alloy used as an active material of a negative electrode of a secondary battery.

15 Claims, 2 Drawing Sheets

SURFACE TREATMENT METHOD OF HYDROGEN ABSORBING ALLOY

BACKGROUND OF THE INVENTION

1. Field of the Invention

The present invention relates to a surface treatment method of a hydrogen absorbing alloy, in particular, to an activation treatment method of a hydrogen absorbing alloy used for an active material of a battery.

2. Description of the Related Art

A hydrogen absorbing alloy absorbs hydrogen at a higher density than a hydrogen-storing cylinder or a liquid hydrogen. In addition, the hydrogen absorbing alloy can reversibly repeat a cycle of absorbing/releasing hydrogen. With this characteristic, the hydrogen absorbing alloy has been used for a heat engine that uses hydrogen as fuel, a chemical heat pump that uses heat generation/absorption corresponding to the absorption/release of hydrogen, a nickel-hydrogen battery using electrochemical hydrogen absorption/release, and so forth.

As hydrogen absorbing alloys that have been used or that will be used, the $LaNi_5$ type, Ti—Fe type, and Zr alloy Laves phase type, that absorb/release hydrogen at normal temperature and at normal pressure or in the vicinity thereof, are known. In particular, the equilibrium pressure at room temperature of the $AB_5$ type hydrogen absorbing alloy represented by $LaNi_5$ and $MmNi_5$ (Mm: misch metal that is a mixture of rare earth group elements such as lanthanum and cerium) or $AB_2$ type hydrogen absorbing alloy represented by TiZrVni type Laves phase alloy such as $ZrV_{0.4}Ni_{1.6}$, is approximately one atmosphere. Thus, these hydrogen absorbing alloys reversibly absorb and release hydrogen at normal temperature and at normal pressure. In addition, these hydrogen absorbing alloys have relatively good corrosive resistance against alkali solutions. Consequently, the hydrogen absorbing alloys can be used as an active material of a negative electrode of a secondary battery that repeats the charging and discharging operations expressed by the following equation.

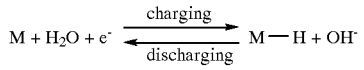

$$M + H_2O + e^- \underset{\text{discharging}}{\overset{\text{charging}}{\rightleftharpoons}} M{-}H + OH^-$$

However, when the surface of the above-described hydrogen absorbing alloy is exposed to air, an oxide layer is easily formed on the surface. The oxide layer prevents the hydrogen absorbing alloy from absorbing/releasing hydrogen. In particular, when an oxide layer is formed on the surface of the hydrogen absorbing alloy used for the negative electrode of a nickel-metal hydride battery, since an Ni catalyst layer that dissolves and activates hydrogen is not present, the hydrogen absorbing alloy does not easily absorb/release hydrogen. Thus, in the initial stage of the battery, it does not have an enough discharging capacity. In other words, when the oxide film is formed on the surface of the hydrogen absorbing alloy, the initial activating characteristic is low.

To solve such a problem, in Tokkaihei 5-13077 and 4-137361, powder of hydrogen absorbing alloy is soaked in alkali solution so as to remove the oxide layer on the surface of the hydrogen absorbing alloy. In addition, mish metal, Co, Al, and Mn are dissolved from the activation surface. Thus, with only Ni, an Ni catalyst layer is formed. However, in this method, the dissolved $Co^{2+}$, $Mn^{2+}$, and so forth become oxides, thereby contaminating the surface of the alloy.

When the alloy powder is soaked in an acidic solution, the similar effect can be obtained. However, in this method, an Ni film that hardly permeates hydrogen may be formed. When a hard Ni film is formed on the surface of the hydrogen absorbing alloy, when it is used for a secondary battery, the initial discharging characteristic deteriorates.

When alkali solution or an acidic solution is used for the surface treatment of the hydrogen absorbing alloy, the resultant solution contains heavy metals (Co, Al, Mn, mish metal, and so forth). Thus, a troublesome waste treatment is required.

Besides the above-described methods, Tokkaihei 3-289047 shows a method for improving the initial activating characteristic of the negative electrode of a battery. In Tokkaihei 3-289047, an electrode composed of the hydrogen absorbing alloy is treated with hydrogen gas so as to be the charging state. The electrode is treated with steam that contains $SO_2$, CO, $CO_2$, and alkali mist so as to deactivate the surface of the electrode and thereby maintain the charging state. However, in this method, since the surface of the electrode is deactivated, the initial discharging capacity is not sufficiently improved.

SUMMARY OF THE INVENTION

An object of the present invention is to provide a method for producing a hydrogen absorbing alloy with an active layer that is less oxidized. Another object of the present invention is to provide a surface treatment method of a hydrogen absorbing alloy that is free from waste.

The present invention is a surface treatment method for a hydrogen absorbing alloy, comprising the step of bringing steam into contact with the hydrogen absorbing alloy in a temperature range from 200° C. to 400° C., so as to cause a surface reaction on the hydrogen absorbing alloy. Steam is contained in a gas and the gas is brought into contact with the surface of the hydrogen absorbing alloy. The gas is an inert gas.

These and other objects, features and advantages of the present invention will become more apparent in light of the following detailed description of a best mode embodiment thereof, as illustrated in the accompanying drawings.

DETAILED DESCRIPTION OF THE INVENTION

Figure 1:
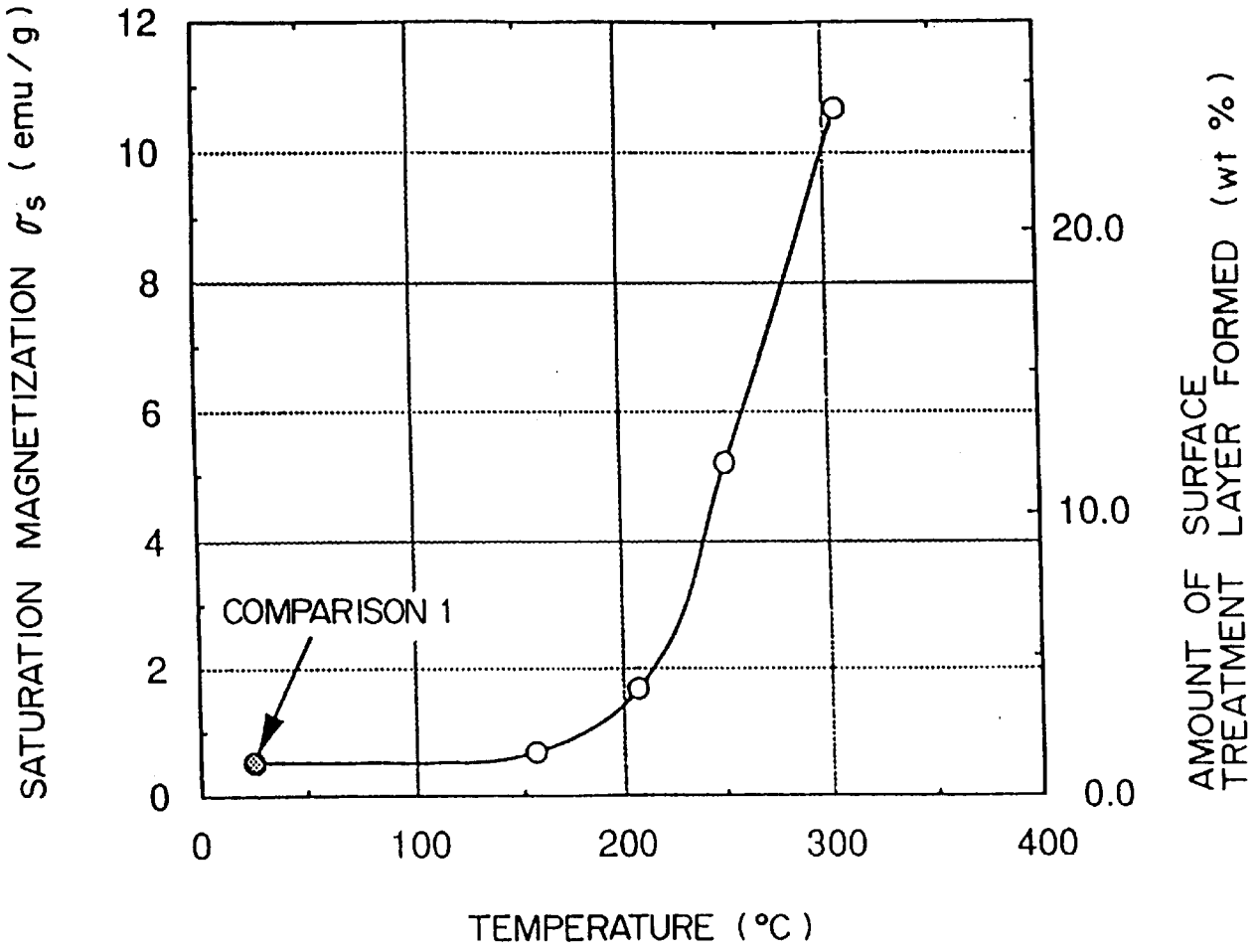
FIG. 1 is a graph showing a saturation magnetization of a hydrogen absorbing alloy powder produced by an activation treatment according to an embodiment of the present invention.

In the surface treatment method according to an embodiment of the present invention, steam is brought into contact with the surface of the hydrogen absorbing alloy in a temperature range from 200° C. to 400° C., so as to cause a surface reaction. Examples of the hydrogen absorbing alloy are an $LaNi_5$ type, Ti—Fe type, and Zr alloy Laves phase type. In particular, an $AB_5$ type hydrogen absorbing alloy represented by $LaNi_5$ or $MmNi_5$ (Mm: misch metal) or an $AB_2$ type hydrogen absorbing alloy represented by TiZrVNi type Laves phase alloy such as $ZrV_{0.4}Ni_{1.6}$, is used.

When steam is brought into contact with a metal, as is well known, a catalytic reaction from contact with water takes place. The water and metal react and thereby hydrogen is generated. In addition, a metal oxide or a metal hydroxide is produced. When energy that is a trigger of the reaction is applied, the contact catalytic reaction of water takes place as expressed by the following equation.

$$2H_2O \rightarrow 2H_2 + O_2$$

In the above reaction, the temperature dependency of the chemical reaction velocity is expressed by the following Arrhenius' equation.

$$kc = A \cdot exp(-E/RT)$$

where T is the absolute temperature, E is the activation energy, and A and R are constants. Thus, when the absolute temperature T rises, the chemical reaction velocity kc increases. Consequently, the velocity of the catalytic reaction from contact with water increases and thereby the amount of hydrogen produced increases.

In the temperature range of 200° C. or lower, the amount of hydrogen produced in the contact catalytic reaction is insufficient. Thus, when an oxide is formed on the surface of the metal in the catalytic reaction from contact with water, the oxide is not reduced. Alternatively, the oxidizing velocity is larger than the reducing velocity. Thus, the oxide (or hydroxide) prevents the surface of the hydrogen absorbing alloy from being activated. (The activation of the hydrogen absorbing alloy removes an oxide that prevents hydrogen from being absorbed/released, and thereby accelerates the absorption/release of hydrogen.) In this low temperature range, the surface of the hydrogen absorbing alloy may be deactivated.

On the other hand, when steam is brought into contact with the hydrogen absorbing alloy in the temperature range of higher than 400° C., the corrosion reaction actively progresses and thereby a thick corrosion layer is produced. However, when the hydrogen absorbing alloy is used for an electrode active material of a battery, a thick corrosion layer causes the characteristics of the battery to deteriorate. In other words, when the degree of corrosion is large, since the amount of the hydrogen absorbing alloy that contributes to the reaction decreases, the discharge capacity decreases. In contrast, when the degree of corrosion is large, since the surface of the hydrogen absorbing alloy is coated with a corrosion substance of low conductivity, the electric resistance increases and the discharge voltage drops. In addition, the resistance component converts the charging/discharging energy into heat and thereby the discharge capacity decreases.

Moreover, in a chemical heat pump, when the amount of corrosion increases, the amount of hydrogen absorbing alloy decreases. Thus, absorbing/releasing hydrogen decreases and thereby the amount of heat decreases. In addition, since the surface of the hydrogen absorbing alloy is coated with a substance whose hydrogen permeability is low, the heat transmissibility decreases.

In the temperature range from 200° C. to 400° C., when steam is brought into contact with the surface of the hydrogen absorbing alloy, the surface of the hydrogen absorbing alloy is activated. The following explanation can be assumed. In this temperature range, when the catalytic reaction from contact with water takes place on misch metal (such as La), Mn, or Al, an oxide or a hydroxide of a metal contained in the hydrogen absorbing alloy is produced. At this point, since a sufficient amount of hydrogen is produced, the oxide or the hydroxide is reduced with the hydrogen. Consequently, the surface of the hydrogen absorbing alloy is activated. In this reductive reaction, hydrogen reduces the Ni compound and thereby Ni metal, which is catalytically active, is produced.

Thus, when steam is brought into contact with the surface of the hydrogen absorbing alloy in the temperature range from 200° C. to 400° C., the surface of the hydrogen absorbing alloy is activated and a Ni catalyst layer is produced. Thus, a good electrode active material for a battery is obtained.

The steam is contained in a gas. The gas is brought into contact with the surface of the hydrogen absorbing alloy. This gas functions as a carrier gas that carries the steam. In addition, the gas functions as an adjustment gas that adjusts the amount of steam. By adjusting the amount of steam, the amount of the active layer of the hydrogen absorbing alloy or the Ni catalyst layer can be properly controlled. When the component of the hydrogen absorbing alloy is changed, the thickness of the active layer of the hydrogen absorbing alloy or the Ni catalyst layer can be flexibly controlled.

As a carrier gas for the steam, a reductive gas such as hydrogen or carbon monoxide is preferably used. A reductive gas removes oxides from the surface of the hydrogen absorbing alloy. To suppress the corrosive reaction, as a carrier gas for the steam, an inert gas is preferably used. Since an inert gas has no reaction with the hydrogen absorbing alloy, an inert gas is especially suitable as a carrier gas for the steam, or an adjustment gas that adjusts the amount of steam.

At the present time, the surface structure of the hydrogen absorbing alloy activated by the above-described surface treatment method has not been sufficiently studied. However, it is considered that the structure of the hydrogen absorbing alloy activated by the surface treatment method, is different from that activated with a solution (such as an alkali solution). In other words, when an alkali solution or the like is used, part of a metal element composing the hydrogen absorbing alloy dissolves in the solution. However, in the case of the hydrogen absorbing alloy produced according to the present invention, no metal element is dissolved in a solution. Thus, it is assumed that the bonding form of the elements varies between these two resultant structures.

As will be described later with experimental data, a preferable temperature range for the steam treatment for obtaining a hydrogen absorbing alloy for use as an active material of a battery, is from 200° C. to 300° C. However, the above-described surface treatment may be effective under a reduced pressure environment or an increased pressure environment. When the pressure environment is varied, the above-described relevant temperature range may vary. In addition, when the treatment apparatus varies, although the critical effect on the hydrogen absorbing alloy against the temperature does not vary, the temperature range in which the desirable effect is obtained may vary to some extent. When the external environment varies, the temperature range may change by 100° C. Thus, when a change in the external environment is also considered, in the temperature range from 200° C. to 400° C. , the desired effect for the surface treatment of the hydrogen absorbing alloy may be obtained.

The treatment performed in the temperature range defined in the present invention (namely, from 200° C. to 400° C.) may be combined with a treatment performed outside of the temperature range defined in the present invention. The effect of the treatment varies depending on the temperature range. However, by properly combining the temperature ranges, the characteristics of these temperature ranges can be obtained. However, in this case, at least one of temperature ranges to be combined should be "the temperature range from 200° C. to 400° C.".

The hydrogen absorbing alloy that has been surface-treated (activated) in the above-described method can be effectively used as a hydrogen storing material, heat pump, or active material of electrode.

Next, an embodiment of the present invention will be described. In the embodiment, as the hydrogen absorbing alloy, $MmNi_{3.6}Co_{0.7}Mn_{0.4}Al_{0.3}$ was mechanically crushed so that the average particle diameters thereof became 25 $\mu$m. In the activation treatment, a glass tube was filled with the powder of the hydrogen absorbing alloy. While the temperature of the glass tube was kept in a predetermined range (from 150° C. to 400° C.), Ar gas passed through steam heated to 50° C. was passed through the glass tube at a flow rate of 1.8 l/min, so that the hydrogen absorbing alloy was brought into contact with the steam. After the hydrogen absorbing alloy and steam had reacted together for approximately one hour, the powder of the hydrogen absorbing alloy was removed from the glass tube. The powder of the hydrogen absorbing alloy was dried in a vacuum and thereby activation-treated powder was obtained.

To examine how the activation treatment with steam causes the surface of the hydrogen absorbing alloy to change, the saturation magnetization of the obtained hydrogen absorbing alloy was measured with a vibrating-sample type magnetometer. By measuring the saturation magnetization, the amount of ferromagnetic substances such as Co or Ni contained in the hydrogen absorbing alloy can be estimated. The state of the surface treatment layer was examined with the obtained values. The measured results are shown in FIG. 1.

As shown in FIG. 1, the saturation magnetization rapidly increases when the treatment temperature exceeds 200° C. When the saturation magnetization is high, the amount of ferromagnetic substance (metal Ni or metal Co) formed is large. Thus, a large Ni catalyst layer is formed and activated. When the amount of the Ni catalyst layer in the surface portion of the hydrogen absorbing alloy is large, if the hydrogen absorbing alloy is used for an electrode of a secondary battery, the electric conductivity characteristic improves. Also, when this hydrogen absorbing alloy is used for a chemical heat pump, the heat conductivity improves.

Thus, when the steam treatment is performed in the temperature range of 200° C. or higher, contact catalyst reaction takes place between the steam and the hydrogen absorbing alloy. Thus, a large amount of hydrogen is produced and thereby a large amount of metal Ni or Co is produced. In other words, when a large amount of hydrogen is produced, in addition to an oxide on the surface of the hydrogen absorbing alloy, an oxide (or a hydroxide) produced by the steam reaction is also reduced by the hydrogen, and thereby metal Ni or Co is produced. Thus, when the amount of such a metal produced is large, the amount of oxide (or hydroxide) is small.

FIG. 1 also shows the measured results of the hydrogen absorbing alloy powder on which the surface treatment has not been performed. The graph in FIG. 1 shows data of up to 300° C. At 350° C., the measured value obtained can be seen on the extrapolated line of the curve shown in FIG. 1.

Next, the characteristic in the case that the hydrogen absorbing alloy activated by the treatment according to the embodiment of the present invention is used for a negative electrode of a secondary battery is shown. In other words, a negative electrode was formed with a paste of the hydrogen absorbing alloy powder activation-treated. With the negative electrode and a nickel positive electrode, a nickel-hydrogen secondary battery was formed. The charging/discharging characteristic of the battery was examined. As samples of the hydrogen absorbing alloy powder used for the negative electrode, a non-activation-treated sample (comparison 1), an alkali-treated sample (comparison 2), and a surface-treated sample according to the embodiment, were prepared. In the alkali treatment, the hydrogen absorbing alloy powder was soaked in a solution of (6.8 N KOH+0.8 N LiOH) for two hours at 110° C. The surface-treated samples according to this embodiment were obtained by surface-treating the hydrogen absorbing alloy powder at 150° C. for one hour, at 200° C. for one hour, at 250° C. for one hour, at 300° C. for one hour, and at 200° C. for one hour then at 280° C. for five minutes.

The negative electrode (paste negative electrode) of the battery was formed in the following method. Each sample of the hydrogen absorbing alloy powder and a solution of methyl cellulose were mixed, and thereby a paste was obtained. Each paste mixture was placed on a foamed nickel electric collector of 30×40 mm. After the resultant substance was dried, it was compressed and a paste electrode with a thickness of approximately 0.6 mm was obtained. As the positive electrode, a paste nickel electrode of 45×60 mm was used.

To form a battery, two positive electrodes were prepared per negative electrode. The positive electrodes and the negative electrode were stacked with a separator that electrically insulated the positive electrodes from the negative electrode. Thus, a battery stack was formed. As an example of the electrolytic solution, (5 N KOH+1 N LiOH) was used. In such a manner, seven types of nickel-metal hydride secondary batteries were produced.

The charging/discharging cycles were performed under the following conditions. The charging operation was performed at 0.2 C until the theoretical capacity of the battery became 120%. The discharging operation was performed at 0.2 C until the battery output voltage became 0.8 V. In these conditions, the characteristics of the initial charging/discharging cycles of the seven types of the batteries were examined. "C" is the unit that represents the current of the battery. "C" is used when the current is represented with the C rate. The definition of the C rate is that the current by which the charge amount of the nominal capacity (Ah) of the battery is discharged in one hour is 1 C. When the battery has a nominal capacity of 100 Ah, 1 C is 100 A and 0.2 C is 20 A. In other words, 0.2 C is equivalent to the widely used "five hour rate capacity".

Figure 2:
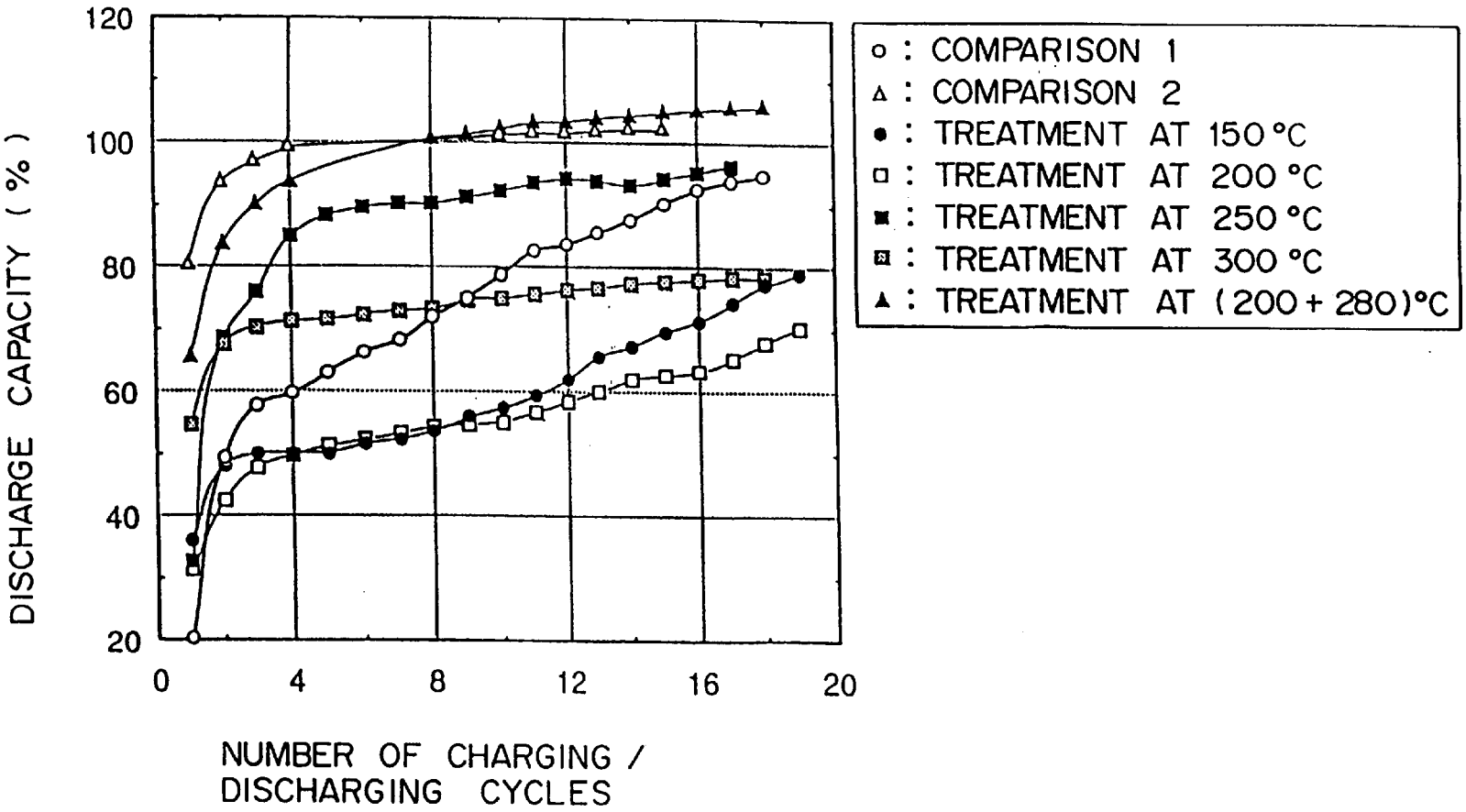
FIG. 2 is a graph showing a change of a discharge capacity in an initial cycle of a nickel-metal hydride battery according to an embodiment of the present invention.

FIG. 2 shows a change in the discharge capacity of each battery in the initial cycle. As shown in FIG. 2, the initial characteristic of the battery using the hydrogen absorbing alloy surface-treated at 150° C. to 200° C. is inferior to the initial characteristic of the battery using the hydrogen absorbing alloy non-activation-treated (comparison 1). In other words, in the surface treatment of the hydrogen absorbing alloy, the contact catalytic reaction does not take place satisfactorily between the steam and the hydrogen absorbing alloy. Thus, a sufficient amount of hydrogen is not produced and the surface of the hydrogen absorbing alloy is not properly activated.

The battery using the hydrogen absorbing alloy surface-treated at 250° C. has a good initial characteristic. The characteristic of this battery is close to the characteristic of the battery using the hydrogen absorbing alloy treated with the alkali-solution (comparison 2). Thus, according to the treatment of this embodiment, the characteristic of the alkali-treated hydrogen absorbing alloy can be obtained without producing waste.

The initial activation of the battery using the hydrogen absorbing alloy surface-treated at 300° C. is high. However, the discharge capacity of this battery in the second or later cycles is inferior to that of the battery using the hydrogen absorbing alloy surface-treated at 250° C. This is because in the surface treatment, the contact catalytic reaction takes place excessively between the steam and the hydrogen absorbing alloy. Thus, the surface treatment layer becomes thick and thereby the amount of alloy that contributes to the hydrogen absorption decreases. On the other hand, a thick corrosion layer is formed.

Consequently, in the above-described surface treatment, the method for bringing steam into contact with a hydrogen absorbing alloy and causing a surface reaction in the temperature range from 200° C. to 400 C., preferably in the temperature range from 200° C. to 300° C., is preferably used.

Although the present invention has been shown and described with respect to a best mode embodiment thereof, it should be understood by those skilled in the art that the foregoing and various other changes, omissions, and additions in the form and detail thereof may be made therein without departing from the spirit and scope of the present invention.

What is claimed is:

1. A surface treatment method for a hydrogen absorbing alloy, consisting essentially of the step of:

contacting steam with the hydrogen absorbing alloy in a temperature range from 200° C. to 400° C. so as to cause a surface reaction of the hydrogen absorbing alloy to generate a sufficient amount of hydrogen and form an active surface layer on the hydrogen absorbing alloy, wherein formation of an oxide layer is minimized.

2. The surface treatment method as set forth in claim 1, wherein the hydrogen absorbing alloy is used for an active material of a battery.

3. The surface treatment method as set forth in claim 1, wherein the hydrogen absorbing alloy is in powder form and is treated at 200° C. for one hour.

4. The surface treatment method as set forth in claim 1, wherein the hydrogen absorbing alloy is in powder form and is treated at 250° C. for one hour.

5. The surface treatment method as set forth in claim 1, wherein the hydrogen absorbing alloy is in powder form and is treated at 300° C. for one hour.

6. The surface treatment method as set forth in claim 1, wherein the hydrogen absorbing alloy is in powder form and is treated at 200° C. for one hour and then at 280° C. for five minutes.

7. A surface treatment method for a hydrogen absorbing alloy, consisting essentially of the step of:

contacting a gas containing steam with the hydrogen absorbing alloy in a temperature range from 200° C. to 400° C. so as to cause a surface reaction of the hydrogen absorbing alloy to generate a sufficient amount of hydrogen and form an active surface layer on the hydrogen absorbing alloy, wherein formation of an oxide layer is minimized.

8. The surface treatment method as set forth in claim 7, wherein the gas is an inert gas.

9. The surface treatment method as set forth in claim 7, wherein the gas is a reductive gas.

10. The surface treatment method as set forth in claim 7, wherein the hydrogen absorbing alloy is used for an active material of a battery.

11. A surface treatment method for a hydrogen absorbing alloy, consisting essentially of the step of:

contacting steam with the hydrogen absorbing alloy in a temperature range from 200° C. to 400° C. in which a metal contained in the hydrogen absorbing alloy and the steam cause a contact catalytic reaction, in the temperature range a sufficient amount of hydrogen being produced for reducing an oxide produced in the contact catalytic reaction and forming an active surface layer on the hydrogen absorbing alloy , wherein formation of an oxide layer is minimized.

12. The surface treatment method as set forth in claim 11, wherein in the temperature range the hydrogen absorbing alloy is not corroded by the steam.

13. The surface treatment method as set forth in claim 11, wherein the hydrogen absorbing alloy is used for an active material of a battery.

14. A method of treating the surface of an hydrogen absorbing alloy which consists essentially of contacting said hydrogen absorbing alloy with a gas mixture consisting essentially of steam and at least one other gas selected from the group consisting of a carrier gas, a reducing gas, and an inert gas at a temperature of from 200° C. to 400° C. so as to cause a surface reaction of the hydrogen absorbing alloy and generate a sufficient amount of hydrogen to form an active surface layer on the hydrogen absorbing alloy, wherein formation of an oxide layer is minimized.

15. The method as set forth in claim 14, wherein the hydrogen absorbing alloy is used for an active material of a battery.

* * * * *